United States Patent [19]

Klotz

[11] Patent Number: 5,060,423

[45] Date of Patent: Oct. 29, 1991

[54] AUTOMATIC CONTROL CENTERLESS FINISHING DEVICE FOR HONING EXTERNAL CYLINDRICAL SURFACES

[75] Inventor: Norbert Klotz, Remscheid, Fed. Rep. of Germany

[73] Assignee: Supfina Maschinenfabrik Hentzen GmbH & Co. KG., Remscheid, Fed. Rep. of Germany

[21] Appl. No.: 369,642

[22] Filed: Jun. 21, 1989

[30] Foreign Application Priority Data

Jun. 21, 1988 [DE] Fed. Rep. of Germany ... 8807980[U]
Sep. 26, 1988 [DE] Fed. Rep. of Germany ... 8812160[U]

[51] Int. Cl.[5] ..... B24B 33/04; B24B 35/00

[52] U.S. Cl. ..... 51/165.71; 51/165.76; 51/165.72; 51/59 SS; 51/289 R

[58] Field of Search ..... 51/165.71, 165.72, 165.76, 51/165.75, 165.74, 59 R, 59 SS, 66, 67, 289 R

[56] References Cited

U.S. PATENT DOCUMENTS 4,558,537 12/1985 MacLeod et al. ..... 51/66
4,573,289 3/1986 Wieck ..... 51/67

FOREIGN PATENT DOCUMENTS 2201445 7/1973 Fed. Rep. of Germany ..... 51/59 R
2350539 4/1975 Fed. Rep. of Germany ..... 51/290
2413000 9/1975 Fed. Rep. of Germany .... 51/59 SS
2814761 10/1978 Fed. Rep. of Germany .
2940566 4/1981 Fed. Rep. of Germany .... 51/59 SS
3007314 9/1981 Fed. Rep. of Germany .
3133246 3/1983 Fed. Rep. of Germany .
3533082 3/1987 Fed. Rep. of Germany ..... 51/204
0747702 7/1980 U.S.S.R. ..... 59/59 SS
0669785 4/1952 United Kingdom ..... 59/59

*Primary Examiner*—Robert A. Rose
*Attorney, Agent, or Firm*—Dennison, Meserole, Pollack & Scheiner

[57] ABSTRACT

In a continuous flow machine with a centerless finishing device for honing external cylindrical surfaces, the device includes a plurality of successive finishing elements with individually feedable finishing stones and a common oscillation drive for oscillation the finishing elements. The device further includes a measuring device to measure the oscillation movement of the finishing elements powered by the common drive. There is a computer which receives the measured signal and compares it to a desired value. Depending on the previous result, an adjustable control means, connected to both the computer and the common drive, will adjust the common drive to perform the necessary oscillation movement of the finishing elements.

12 Claims, 2 Drawing Sheets

AUTOMATIC CONTROL CENTERLESS FINISHING DEVICE FOR HONING EXTERNAL CYLINDRICAL SURFACES

BACKGROUND OF THE INVENTION

Field of the Invention

The present invention relates to a centerless finishing machine for finishing external surfaces of cylindrical workpieces which are fed through the machine on a continuous basis. In particular, the present invention relates to machines having pneumatic oscillators for moving finishing stones and to control devices of the machines. However, the present invention is not confined to this type of machine and may have hydraulic electromagnetic or spring-mechanized drives.

Finishing machines are for finishing external cylindrical surfaces for improving the quality of the external surface of workpieces. Finishing machines are also for shaping the radius of curvature and for adjusting these workpieces to an exact size.

The present invention is an improvement on a finishing machine described in U.S. Pat. No. 4,558,537. The disclosure of the finishing machine of U.S. Pat. No. 4,558,537 is incorporated herein by reference. This patent discloses that workpieces are supported between two drive rollers and set in rotation by these rollers. These two drive rollers rotate in the same direction. A plurality of finishing elements are arranged side by side above the rollers and the workpieces. Each finishing element consists of a finishing stone which is held by a stone holder. A piston rod connects the stone holder to a control cylinder. The finishing stone can be controlled by means of this control cylinder to move towards or away from the workpiece.

The contact pressure of the finishing stone can be varied by means of a controller for adapting the contact surfaces and to compensate for erosion of the finishing stone. The finishing stones are further set in an oscillating motion in the direction of the drive roller axes.

Tests on centerless continuous feed machines have shown that the abrasive wear on the material and therefore the quality of the workpiece, quite apart from technological parameters, e.g. the speed of the roller, the angle of the finishing stone to the workpiece, the contact pressure, is connected to the oscillation amplitude of the finishing or honing stone.

It has been further established that a change in the contact properties, between workpiece and tool (workpiece material, type of stone, number of stones used, contact pressure, length of stones) has a direct influence on the resulting oscillating amplitude. Accordingly, a problem that has arisen in centerless feed machines is to achieve a consistent standard in the quality of a particular job-on-hand. One way to solve this problem is to keep the oscillating amplitude of the machine constant, since the oscillating amplitude exerts the most influence on the finished product.

German Patent No. DE-28 14 761 describes a complex oscillation process for smoothing limited surfaces as well as the drive devices and for generating oscillation. The oscillation movements are controlled manually or via an electronically operated end switch.

German Patent No. DE-30 07 314 describes a process and a device for honing the surface of a bearing. The oscillation of the honing stones is controlled by either manual or electrical operated end switches.

German Patent No. DE-31 33 246 describes a tool machine having a range limitation device without mechanical intervention. The machine includes a potentiometer which builds up voltage corresponding to the current position of the tool. This stored voltage is compared to pre-set voltage limits in order to determine the distance limitation for the tool position.

However, the devices described in these documents permit only a rough control over the tool movements. Accordingly, the prior art devices are not capable of keeping the oscillation amplitude of the machine constant.

SUMMARY OF THE INVENTION

Object of the present invention is to provide an automatic device with an appropriate switch, which will make possible the precise regulation of the movement of the operating tools. In particular the present invention regulates the movement of the finishing stones. By regulating the movement of the finishing stones, the present invention keeps the oscillation amplitude constant.

Another object of the present invention is to provide a means for visually displaying the variable parameters.

These objects and others to become apparent as the specification progresses, are accomplished by the invention, according to which, briefly stated is an automatic centerless finishing device for honing external cylindrical surfaces in a continuous flow machine which has a plurality of successive stones which are caused to oscillate by means of a common drive. The common oscillation drive together with all the driven parts is connected to a measuring device for measuring the oscillation movement. The electrical output of the measuring device is connected to a computer to which the desired value is fed by means of lead and whose output is fed in turn to an adjustable control instrument and then to the oscillation drive.

The measuring device for measuring the oscillation movement can be an acceleration measuring device whose electrical output is connected to the computer via integrators. Also, the measuring device for measuring the oscillation movement can be a distance measuring device, whose electrical output is directly connected to the computer.

There is a visual indicator for showing the oscillation amplitude and it is inserted between the distance device and the computer. Furthermore, between the acceleration measuring device and the computer, there are junction lines which lead to visual indicators. A direct line for transmission of an oscillation frequency leads from the acceleration measuring device to the computer, and other lines for transmission of an oscillation amplitude from the acceleration measuring device to the computer interconnect two integration stages.

The junctions for the indicators are arranged between the acceleration measuring device and the computer on the connecting lines at the following positions:

a) on the direct line from the acceleration measuring device to the computer;
b) before the first integration stage;
c) before the second integration stage; and
d) after the second integration stage.

The device may include a servo valve in a fluid pressure conductor functioning as the adjustable control instrument. The oscillation drive can be performed in a single or double working cylinder, and the acceleration measuring device operates in the form of a weight pendulum, whose force is measured by means of springs, carbon pressure, through induction or capacity measuring or by means of piezoelectric effect.

The innovative control device can also be attached to already existing finishing machines.

Further details, characteristics and advantages of the invention are revealed from the following description and the drawings.

DESCRIPTION OF PREFERRED EMBODIMENTS

Figure 1:
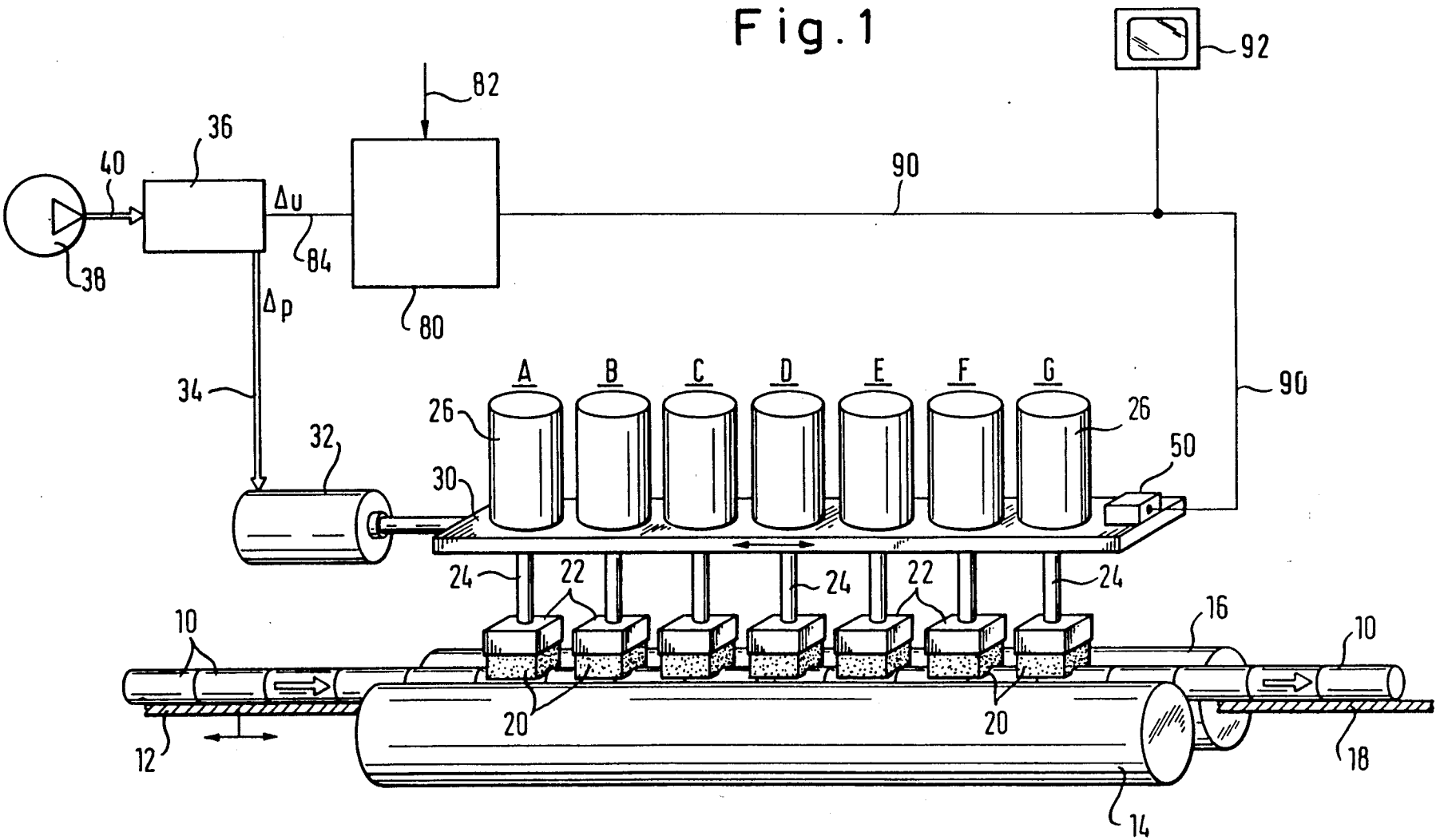
FIG. 1 is a partial schematic illustration of a central portion of a centerless continuous flow super finishing machine with a control device, in which a distance measuring device is provided as a movement detector.
Figure 2:
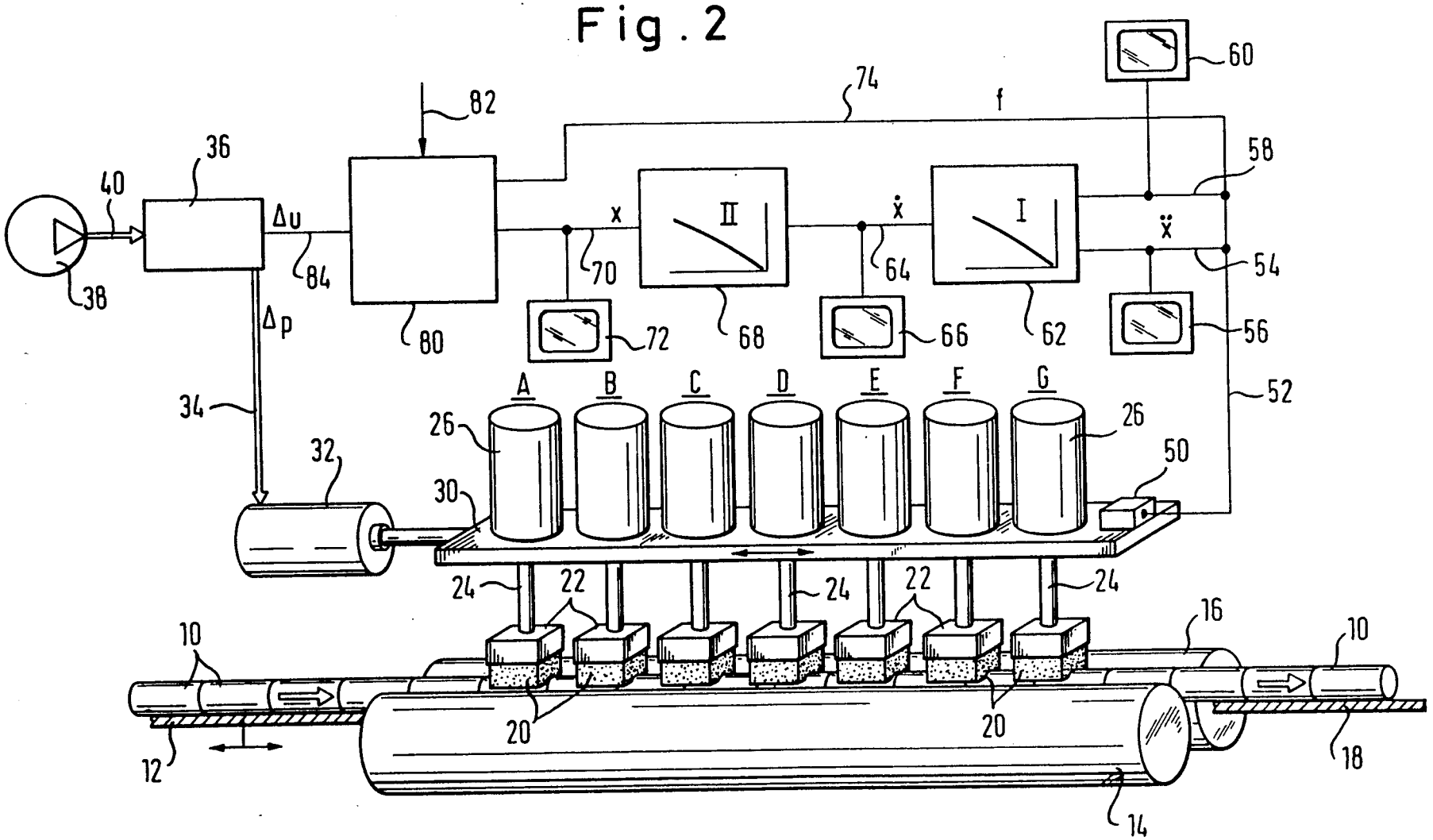
FIG. 2 is a partial schematic illustration of another embodiment of a central portion of a centerless continuous flow super finishing machine with a control device, in which an acceleration measuring device is provided as a movement measuring device.

Referring to FIG. 1, a glide means 12 is shown over which the individual workpieces 10 are continuously fed in the direction of the arrow. The workpieces 10 in FIGS. 1 and 2 are in cylindrical rollers which are fed from a previous machine, for example, a grinding machine (not shown). The outer surfaces of these workpieces 10 are finished by a succession of finishing elements until the final desired surface quality is achieved. A second glide means 18 transports (in the direction of the arrow) the finished workpieces from the machine to the next destination.

Two drive rollers 14 and 16 act as a centerless support for the workpieces 10 and also act to advance the workpieces along the rollers during the finishing operation. The rollers 14 and 16 both rotate in the same direction thereby also causing the workpieces 10 to rotate as the workpieces are transported on glide means 12, 18. The distance between the axes of the rollers 14 and 16 increases slightly along their path causing the workpieces 10 to travel in a forward direction.

In the preferred embodiments, there are seven successive finishing elements 19A–19G which will be collectively referred to as finishing element 19. Each finishing element 19 has a finishing stone 20. The finishing stone 20 is held by a stone holder 22. The stone holders 20 are connected to feeder rods 24 which are movable towards and away from the workpieces 10 and which are connected to and activated by cylinders 26. With this arrangement, each individual finishing stone 20 can be moved towards and away from the workpieces 10, independently from the finishing stones 20 of the other finishing elements, thereby allowing for differing dimensions of finishing stones 20 or differing finishing operations.

The individual finishing elements 19 are connected to each other via a board 30 which is in the direction of the axes of the rollers 14 and 16. This board 30 is connected on one side to a piston 32. With the aid of this piston 32 the board 30 can be set in a fast oscillating motion in the direction of the axes of the rollers 14 and 16. This leads simultaneously to a to and fro drive movement of the finishing stones 20. The piston 32 is pneumatically activated, for which purpose an air pressure lead 34 is provided which is connected to a pressure generator 38 via a servo control valve 36 and a further air pressure lead 40.

The board 30 is further equipped with a movement detector 50 for measuring the movement of the board and with it also the finishing stones 20.

In FIG. 1, a distance measuring device 50 is a movement detector with which the oscillation amplitude and the frequency of movement of the honing stones 20 is determined. Resistance transmitters or inductive transmitters could, for example, be used as distance measuring devices.

The distance measuring device 50 is connected, via a measuring line 90, to an indicator 92 for showing the amplitude and frequency of the oscillation. The distance measuring device 50 is then connected to a computer 80.

The computer 80 compares the actual value of the amplitude and frequency of the board 30 fed to it through lead 90 with the desired value of amplitude and frequency fed to it through lead 82.

The computer 80 is connected to the control valve 36 via an outlet lead 84. Depending on the differences between actual and desired values of the amplitude and frequency of movement of the board 30, the computer controls, via the servo control valve 36, the pressure in the piston 32 and therefore the oscillation amplitude of the finishing stones 20. The piston 32 which is the oscillation driver can be either a single or double working cylinder.

There is the common connector 90 linking the finishing stones 20, via which the finishing stones are caused to oscillate simultaneously, and which contains a sensor for measuring the movement. The movement of the finishing stones 20 is measured by the distance measuring device 50 as shown in FIG. 1 or an acceleration measuring device as shown in FIG. 2. The measurements are displayed for control purposes and fed to the computer 80 for evaluation. The actual values are fed to the computer 80 by the measuring line 90. The computer 80 receives the accompanying desired values of these measurements via a further lead 82. The computer 80 compares these values and, according to the result, regulates the oscillating movement of the finishing stones 20. The output of the computer 80 is connected by a control line 84 to an adjustable pressure valve 36. This pressure valve 36 is situated in a pressure supply line 34 of a pneumatic cylinder 32 which serves as an oscillation drive for the finishing stones. The piston rod of this cylinder 32 is connected to the common connector of the finishing stones 20.

The following advantages are achieved by the control device of the present invention:

1. A constancy of amplitude is achieved when idling and during use (for example, by setting up the machine);
2. A control of the oscillation function is accomplished;
3. A regulation of the oscillation amplitude over a long time span, in consequence of changes in friction and wearing away processes, is achieved;
4. A regulation of the oscillation amplitude required due to changes in the process and the measurements of which are available is solved;
5. A consistent erosion of material despite differing contact conditions, (i.e., quality consistency) is maintained;
6. There is a realization of a defined finishing task with a predeterminable and non-dependent amplitude;
7. The finishing process is consistently and highly monitored; and 8. By visually checking on the amplitude, human intervention is allowed to monitor and adjust the machine.

Referring now to FIG. 2, the acceleration measuring device is a movement detector 250 to determine the acceleration and frequency of movement of the board 230 and therefore, the finishing stones 220. A sounding probe or inertia detecting element with capacitive, inductive or piezoelectrical converter could, for example, be used as an acceleration measuring device. Also, the acceleration measuring device 250 could operate in the form of weight pendulum whose force is measured by means of springs and carbon pressure.

The acceleration measuring device 250 and a wire 254 are connected via a measuring line 252 to an indicator 256 for showing the acceleration.

The acceleration measuring device 250 is connected to a further indicator 260 for showing the frequency of the movement of the board 230 by means of another wire 258. Both wires 254 and 258 are connected to an integrator 262 whose output is fed to a further indicator 266 for showing the speed of movement of the board 230 via a line 264. The line 264 is also connected to a second integrator 268 whose output fed, via a line 270, to an indicator 272 for showing the distance of movement of the board 230.

The line 270 is also connected to a computer 280. The wire 258 of the acceleration measurement device 250 is likewise connected to the computer 280 via a line 274. The computer 280 compares the actual values of the acceleration and the frequency of the board 230 by it via lines 270 and 274 with the desired values of acceleration and frequency received by it via line 282.

The computer 280 is connected to the servo control valve 236 via an output line 284. Depending on the differences between actual and desired values of the acceleration and frequency of movement of the board 230, the computer 280 controls, via the servo valve 236, the pressure in the piston 232 and therefore the oscillation amplitude of the honing stones 220.

The operation of the system shown in FIG. 2 will now be explained in more detail.

The system controls, during the progress of workpieces 210 through the centerless continuous flow machine, the oscillation amplitude of all finishing elements 219A–219G and therefore the oscillating movement of the finishing stones 220 on the surface of the workpieces 210. The system further controls the reactions to any influences which would lessen the oscillation amplitude. To achieve this result the acceleration measuring device 250 reacts to every single acceleration detected by acceleration measuring device 250. To detect acceleration on an electrical signal $\ddot{x}_{ist}$, which is proportional to the second derivation of the actual path, is generated from the acceleration measuring device 250. The signal $\ddot{x}_{ist}$ can be shown in two ways. The actual acceleration is shown in $m/s^2$ on the visual indicator 256. Each deviation from the desired acceleration can therefore be read and noted.

The oscillation per unit of time which is derived from the signal $\ddot{x}_{ist}$ shown on the second visual indicator 260. In the first integrator 262, as a first integration step, the speed is obtained from the acceleration in the form of an electrical signal x and displayed on the visual indicator 266. This electrical signal x is fed to the second integrator 268. At this integration stage, an electrical signal x, representing the maximum distance or finishing distance, is determined from the speed and displayed on the visual indicator 272 as well as fed to the computer 280 as a true value.

The aforementioned individual indicators 256, 260, 266 and 272 and 72 are not in practice individual instruments, but indicators which may be plugged into a display instrument already existing on the machine, for example, a central monitor, on which the desired values for the setting up of the machine or for other purposes can be displayed. The possibility to take readings of the values for the acceleration, the frequency, the speed and the amplitude, represents indeed a control possibility for the operative but is not sufficient for the later automatic regulation, in the sense of maintaining constancy of amplitude.

For the automatic regulation of the amplitude, the obtained and processed electrical quantities are connected to the computer 280, in the case of the frequency $f_{ist}$ via the lead 274 and in the case of the path x via the lead 270.

In computer 280, a comparison takes place with the desired value for the amplitude fed into it through line 282. Every difference between a desired value provided and a determined actual value x is carried to an electrical control signal ΔAU in the control line 284 and to a control valve 236. According to the direction and size of the control signal ΔAU, a pressure change ΔAP in the air pressure lead 234 for the pneumatic device of the oscillation movement and thus the finishing stones 220 occurs.

A variation which is not illustrated is that the actual value of the speed $\dot{x}$ or the acceleration $\ddot{x}$ can be carried directly to the computer 280, while at the same time appropriate desired values instead of or in addition to the amplitude desired value are fed to it.

The present disclosure relates to subject matter contained in German Gebrauchsmaster Application Nos. G 88 07 980.5 (filed June 21, 1988) and G BB 12 160.7 (filed Sept. 26, 1988) which are incorporated herein by reference.

It will be understood that the above description of the present invention is susceptible to various modifications, changes and adaptations, within the meaning and range of equivalents of the appended claims.

I claim:

1. In a continuous flow machine with a centerless finishing device for honing external cylindrical surfaces, said device including a plurality of successive finishing elements with individually feedable finishing stones and a common oscillation drive connected to each said plurality of successive finishing elements for oscillating said elements; wherein the improvement comprising:

a measuring device connected to said common oscillation drive for measuring the oscillation movement of said plurality of successive finishing elements generated by said common drive;

computer means connected to said measuring device and receiving a signal representing the measured oscillation movement, said computer means comparing the received oscillation movement signal to a desired value and generating an adjustable signal representing the comparison; and adjustable control means, connected to said computer means and said common oscillation drive, for receiving the adjustable signal and for generating a control signal to adjust said common oscillation drive.

2. In a continuous flow machine with a centerless finishing device for honing external cylindrical surfaces, said device including a plurality of successive finishing elements with individually feedable finishing stones and a common oscillation drive connected to each said plurality of successive finishing elements for oscillating said elements; wherein the improvement comprising:

an acceleration measuring device connected to said common oscillation drive for measuring a signal representing acceleration of the oscillation movement of said plurality of successive finishing elements generated by said common drive;

computer means connected to said measuring device and receiving a signal representing the measured oscillation movement, said computer means comparing the received oscillation movement signal to a desired value and generating an adjustable signal representing the comparison;

adjustable control means, connected to said computer means and said common oscillation drive, for receiving the adjustable signal and for generating a control signal to adjust said common oscillation drive; and a plurality of integrators connected between said measuring device and said computer, said first integrator determines the speed of said finishing element from the acceleration signal, and said second integrator determines a maximum distance from the speed determined by said first integrator.

3. The finishing device of claim 1, wherein said measuring device is a distance measuring device.

4. The finishing device of claim 3, wherein a visual indicator is connected between said distance measuring device and said computer means for showing an amplitude of the oscillation movement.

5. The finishing device of claim 2, wherein a plurality of junction lines are connected between said acceleration measuring device and said computer means, and a plurality of visual indicators are connected to said plurality of junction lines.

6. The finishing device of claim 2, wherein a direct line for transmission of an oscillation frequency connects said acceleration measuring device and said computer means.

7. The finishing device of claim 2, wherein a plurality of transmission lines for transmitting a oscillation amplitude connect said acceleration measuring device to said plurality of integrators and said plurality of integrators to said computer means.

8. The finishing device of claim 7, wherein said plurality of junction lines connected to said visual indicators are positioned between said acceleration measuring device and said computer on said connecting lines so that at least one of said plurality of visual indicators is at one of the following positions: a) said direct line between said acceleration measuring device and said computer, b) before said first integrator, c) before said second integrator, and d) after said second integrator.

9. The finishing device of claim 2, wherein said adjustable control means is a servo value in a fluid pressure conductor.

10. The finishing device of claim 1, wherein said common oscillation drive is a single working drive.

11. The finishing device of claim 1, wherein said common oscillation drive is a double working drive.

12. The finishing device of claim 2, wherein said acceleration measuring device is a weight pendulum whose force is measured by means of at least one of the following a) springs and b) carbon pressure, through at least one of the following a) induction measuring, b) capacity measuring, and c) by means of piezoelectric effect.

* * * * *